US006997820B2

(12) United States Patent
Willett et al.

(10) Patent No.: US 6,997,820 B2
(45) Date of Patent: Feb. 14, 2006

(54) GOLF CLUB HAVING AN IMPROVED FACE PLATE

(75) Inventors: Kraig Willett, Fallbrook, CA (US); Joseph H. Hoffman, Carlsbad, CA (US); Benoit Vincent, Leucadia, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 75 days.

(21) Appl. No.: 10/279,768

(22) Filed: Oct. 24, 2002

(65) Prior Publication Data

US 2004/0082404 A1 Apr. 29, 2004

(51) Int. Cl.
*A63B 53/04* (2006.01)

(52) U.S. Cl. ..... 473/329; 473/349; 473/350; 473/342

(58) Field of Classification Search ..... 473/324, 473/349, 329, 345–346, 350, 290–291, 342; D21/747–752
See application file for complete search history.

(56) References Cited

U.S. PATENT DOCUMENTS

| | | | | |
|---|---|---|---|---|
| 3,814,437 A * | 6/1974 | Winquist | 473/350 |
| 5,830,084 A | 11/1998 | Kosmatka | 473/349 |
| 5,873,795 A | 2/1999 | Wozny et al. | 473/350 |
| 5,921,869 A | 7/1999 | Blough et al. | 473/291 |
| 5,971,868 A * | 10/1999 | Kosmatka | 473/349 |
| 6,007,432 A | 12/1999 | Kosmatka | 473/324 |
| 6,368,234 B1 | 4/2002 | Galloway | 473/349 |
| 6,398,666 B1 | 6/2002 | Evans et al. | 473/345 |
| 6,413,169 B1 | 7/2002 | Kosmatka | 473/329 |
| 6,428,425 B1 | 8/2002 | Naruo et al. | 473/329 |
| 6,435,981 B1 | 8/2002 | Naruo et al. | 473/329 |
| 6,454,665 B1 | 9/2002 | Antonius | 473/346 |
| 2004/0083596 A1 * | 5/2004 | Willett et al. | 29/557 |
| 2004/0106466 A1 * | 6/2004 | Wieland et al. | 473/349 |
| 2005/0032586 A1 * | 2/2005 | Willett et al. | 473/350 |

FOREIGN PATENT DOCUMENTS

| | | |
|---|---|---|
| JP | 09-154985 | 6/1997 |
| JP | 09-168613 | 6/1997 |
| JP | 09-192273 | 7/1997 |
| JP | 2002-065907 | 3/2002 |

OTHER PUBLICATIONS

"Golf Club Component," *Golf Equipment Universal Catalogue*; p. 556.

* cited by examiner

*Primary Examiner*—Sebastiano Passaniti
(74) *Attorney, Agent, or Firm*—Sheppard, Mullin, Richter & Hampton LLP

(57) ABSTRACT

A golf club head is provided having an increased sweet spot across its club face. A preferred construction includes a face plate having vertical zone of increased thickness and a central region having a reduced thickness. An upward extension of the vertical zone comprises divergent segments separated by an upper region of reduced thickness. The face plate material is preferably metallic, but in alternative embodiments may be formed of a composite or non-metal material. Methods for manufacturing a golf club head having a face plate with the thicknesses of the present invention include forging and machining techniques. The club head may be a wood-type or iron.

8 Claims, 4 Drawing Sheets

GOLF CLUB HAVING AN IMPROVED FACE PLATE

BACKGROUND OF THE INVENTION

The present invention relates generally to the game of golf and, more particularly, to an improved striking face plate for golf club heads.

Modern golf clubs have typically been classified as either woods, irons or putters. The term "wood" is an historical term that is still commonly used, even for golf clubs that are constructed of steel, titanium, fiberglass and other more exotic materials, to name a few. The woods are now often referred to as "metal woods." The term "iron" is also an historical term that is still commonly used, even though those clubs are not typically constructed of iron, but are rather constructed of many of the same materials used to construct "woods."

Many advancements have been achieved, particularly over the past couple of decades, to make it easier to hit longer and straighter shots with woods and irons. In general, golf clubs are now designed to be more forgiving, so that shots that are struck less than perfectly will still have fairly consistent distance and directional control. Moreover, club heads now are commonly constructed of combinations of materials, to attempt to optimize the ball flight desired by a particular type of player.

One particular improvement that relates especially to metal woods is the use of lighter and stronger metals, such as titanium. A significant number of the premium metal woods, especially drivers, are now constructed primarily using titanium. The use of titanium and other lightweight, strong metals has made it possible to create metal woods of ever increasing sizes. The size of metal woods, especially drivers, is often referred to in terms of volume. For instance, current drivers may have a volume of 300 cubic centimeters (cc) or more. Oversized metal woods generally provide a larger sweet spot and a higher moment of inertia about the center of gravity (COG), which provides greater forgiveness than a golf club having a conventional head size.

One advantage derived from the use of lighter and stronger metals is the ability to make thinner walls, including the striking face plate and all other walls of the metal wood club. This allows designers more leeway in the distribution of mass within a club head. For instance, to promote forgiveness, designers may move the weight to the periphery of the metal wood head and rearward from the face. As mentioned above, such weighting generally results in a higher moment of inertia about the COG, which results in less twisting due to off-center hits.

There are limitations on how large a golf club head can be manufactured, which is a function of several parameters, including the materials used to construct the club head, the weight of the club head and the strength of the club head. Additionally, to avoid increasing weight, as the head becomes larger, the thickness of the walls must be decreased, including that of the striking face plate. As the striking face plate becomes thinner and thinner, it has a tendency to deflect more and more at impact, and thereby has the potential to impart more energy to the ball. This phenomenon is generally referred to as the "trampoline effect." A properly constructed club with a thin face plate can therefore impart a higher initial velocity to a golf ball than a club with a rigid face plate. Because initial velocity is an important component in determining how far a golf ball travels, this is very important to golfers.

It is appreciated by those of skill in the art that the initial velocity imparted to a golf ball by a thin-faced metal wood varies depending on the location of the point of impact of a golf ball on the striking face plate. Generally, balls struck in the sweet spot will have a higher rebound velocity. Many factors contribute to the location of the sweet spot, including the location of the center of gravity (CG) and the shape and thickness of the striking face plate.

Manufacturers of metal wood golf club heads have more recently attempted to manipulate the performance of their club heads by designing what is generically termed the variable face thickness profile for the striking face plate. Because of the use of lightweight materials such as titanium for the striking face plate, a problem arises in the stresses that are transmitted to the face-crown and face-sole junctions of the club head upon impact with the golf ball. One prior solution has been to provide a reinforced periphery of the face plate in order to withstand the repeated impacts of the club head with a golf ball.

Another approach to reduce these stresses at impact is to use one or more ribs extending substantially from the crown to the sole vertically across the face, and in some instances extending from the toe to the heel horizontally across the face. Because the largest stresses are located at the impact point, usually at or substantially near the sweet spot, the center of the face plate is also thickened and is at least as thick as the ribbed portions. However, these club heads fail to ultimately provide much forgiveness to off-center hits for all but the most expert golfers. The variable face thickness design and the use of titanium face inserts have also recently been applied to iron golf club heads with similar disadvantages and limitations.

SUMMARY OF THE INVENTION

The present invention provides a solution to enable club designers to provide the benefits described above, including a golf club head that exhibits greater forgiveness across a substantial portion of the striking face while continuing to impart higher initial velocity to a golf ball. The distribution of mass on a thinner striking face plate helps achieve a desired high COR while maintaining durability. Advantages of this improved golf club face plate are applicable to wood-type heads as well as golf club heads for irons. Generally, the present invention can be practiced using a variety of common club head shapes that are known in the art.

In a first preferred embodiment, the present invention comprises a front impact surface and a rear surface having a vertical zone of increased thickness. Located within the vertical zone is a central recess of reduced thickness. The vertical zone extends a width at least 30% of the total distance measured in a toe to heel direction of the face plate insert. The vertical zone extends downwardly from the central recess toward a bottom edge of the face plate and diverges upwardly from above the central recess toward a top edge of the face plate. An upper recess of reduced thickness is formed between upper segments of the vertical zone, with the thickness of the vertical zone near the bottom edge providing stress management for durability and the reduced thicknesses of the central recess and upper recess providing improved mass distribution and stress management for the face plate when incorporated into the golf club head.

Alternatively, the rear impact surface variation in thickness may be provided on a front wall that is integrally formed with at least the top, toe portion and heel portion of the club head.

A preferred method of the present invention comprises the steps of:

forming a first surface on a first side of a face plate, the first surface being adapted to impact a golf ball; and forming a second surface on a second side of the insert. The face plate has a vertical zone of increased thickness, with a central recess of reduced thickness, and the vertical zone extends a width at least 30% of the total distance measured in a toe to heel direction of the insert. More preferably, the vertical zone extends at least 33% of the total distance. In the forming step the vertical zone extends downwardly from the central recess toward a bottom edge of the face plate and diverges upwardly from above the central recess toward a top edge of the face plate insert, such that an upper recess of reduced thickness is formed between upper segments of the vertical zone. The thickness of the vertical zone near the bottom edge provides stress management for durability and the reduced thicknesses of the central recess and upper recess provide improved mass distribution and stress management for the face insert when incorporated into a golf club head.

DETAILED DESCRIPTION OF THE PREFERRED EMBODIMENTS

Figures 1, 2:
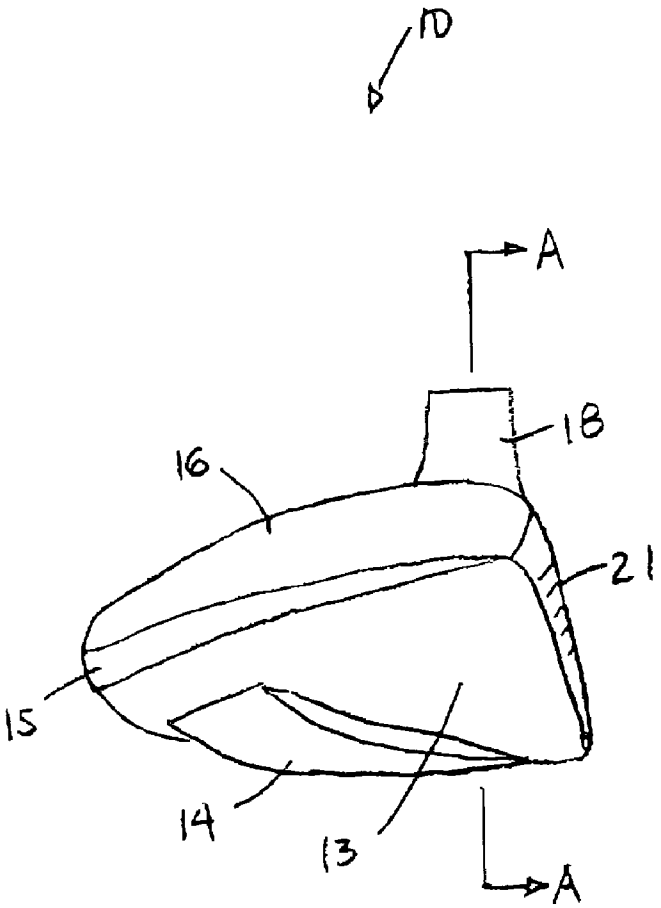
FIG. 1 is a front view of a wood-type club head in a first preferred embodiment of the present invention.
FIG. 2 is a toe end view of the club head of FIG. 1.

The drawings depict several preferred embodiments of a golf club face insert for different types of golf club heads, in accordance with the present invention. With reference to FIG. 1, a club head 10 is shown that is similar to many metal wood club heads that are known in the art. Club heads within the scope of the invention are not necessarily limited to the shapes depicted. The club head 10 comprises a hollow metallic body 11 and a face plate 20. The body 11 comprises a heel portion 12, a toe portion 13, a sole portion 14, skirt or side portion 15 and a crown portion 16 that cooperate to define an opening periphery 17 (see FIG. 3). The club head 10 is normally connected to a shaft (not shown) by a hosel 18 that is integrally formed with the body 11. Preferably, the body and/or the face plate are constructed of stainless steel, titanium or alloys thereof, but alternatively can be constructed of various other materials such as a fiber composite or metal matrix.

The club head 10 is preferably manufactured such that the body 11, including the heel portion 12, toe portion 13, sole portion 14, side portion 15, crown portion 16, and hosel 18, are integrally formed, and the face plate 20 having a striking face 21 is fixedly attached to the opening periphery 17 by means known in the art. However, the various portions of the preferred body 11 may be separately molded, cast, forged or otherwise manufactured by means known in the art, and fixedly attached to form the body 11 by means known in the art.

Figure 3B:
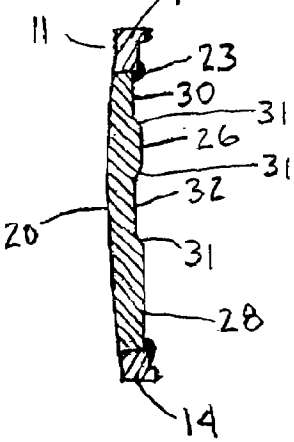
FIG. 3B is a lateral cross-sectional view taken along line C—C of FIG. 3.
Figure 3A:
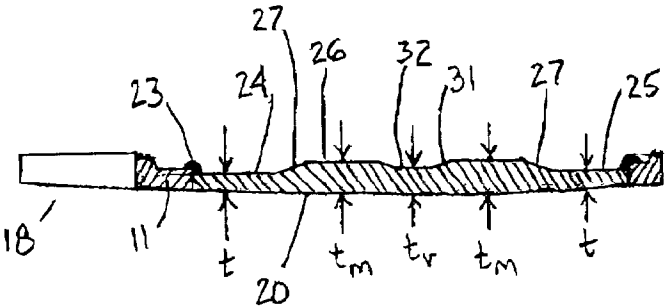
FIG. 3A is a longitudinal cross-sectional view taken along line B—B of FIG. 3.
Figure 3:
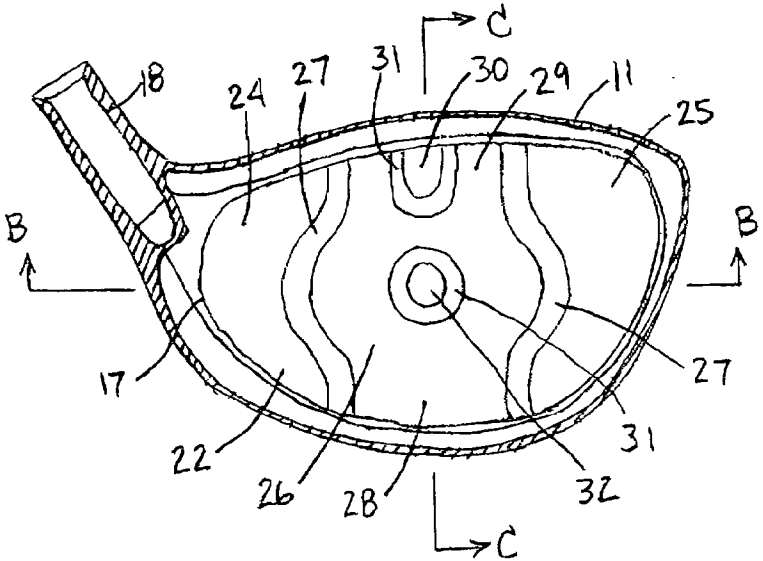
FIG. 3 is a cross-sectional view taken along line A—A of FIG. 2 and showing a vertical zone with central and upper recesses.
Figure 6:
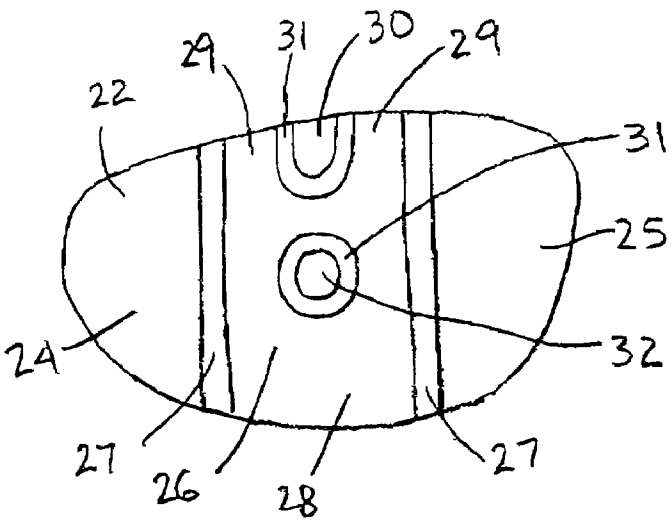
FIG. 6 is a rear view of a face insert in yet another embodiment of the vertical zone with central and upper recesses.

A preferred face plate 20 is machined or may alternatively be forged to have a variable thickness, as shown in FIGS. 3, 3A and 3B. FIG. 3 shows a rear surface 22 of the face plate 20 formed using a preferred machining method.

The face plate 20 is welded along its periphery, and at the rear the weld bead 23 is visible. Heel and toe zones 24, 25 of the face plate 20 have a common thickness t that is preferably less than the adjacent thickness of the body 11 at the front opening periphery 17. A vertical zone 26 has a maximum thickness $t_m$ of the face plate 20, with transition regions 27 formed between the heel and vertical zones 24, 26 and the toe and vertical zones 25, 26. A lower region 28 of the vertical zone 26 extends toward the sole portion 14, and upper segments 29 extend toward the crown portion 16. Between the upper segments 29 is an upper recess 30 that has a thickness $t_r$ less than the maximum thickness $t_m$ but preferably greater than the thickness t of the heel and toe zones 24, 25. A transition region 31 is formed between the upper segments' thickness $t_m$ and the thickness $t_r$ of upper recess 30.

In addition for the present invention, at desirably the center of the face plate 20 is a central recess 32 that preferably has a thickness $t_r$ substantially the same as the thickness of upper recess 30 and with a similar transition region 31 between the thickness of the central recess 32 and the thickness of the vertical zone 26. Applicants have found that the thickness at the center of the face plate 20 need not be the thickest, as in conventional club heads. Further, the reinforcement at the crown junction can be achieved without requiring a constant increase in thickness along the junction, as in the prior art. The two 30, 32, recesses, or possibly more if a plurality of smaller recesses are included instead, thus provide improved mass and stress management of the face plate 20. The end result, as determined by the applicants, is a higher COR (at least 0.80) that is achieved across a larger impact area of the striking face 21.

Preferably, the central recess 32 and transition region 31 extend a distance between 20% and 50% of the width of the vertical zone 26 and transition regions 27 measured in a toe 13 to heel 17 direction. In the preferred embodiment of FIG. 3, the toe and heel zones 25, 24 of the rear surface 22 each have a thickness t less than 2.5 mm and the thickness of the vertical zone is at least 3.0 mm. The reduced thickness $t_r$ of each of the central recess 32 and upper recess 30 is about 0.5 mm less than the thickness $t_m$ of the vertical zone 26. More preferably, the thicknesses t, $t_r$, $t_m$ are 2.2 mm to 2.4 mm, 3.0 mm to 3.2 mm and 3.5 mm to 3.7 mm, respectively.

As shown in FIGS. 3A and 3B, the transition regions 27, 31 comprise chamfered surfaces; however, a web transition having a generally concave cross-section may alternatively be used. A step transition may be used but is less desirable due to stress concentrations as well as difficulties in manufacturing. That is, the cross-section preferably comprises a linear transition for a chamfered surface, or the cross-section may comprise a radiused surface for a webbed transition between the vertical zone 26 and the recesses 30, 32 and the heel and toe zones 24, 25. Again, while the embodiments of FIGS. 1–6 comprise separate face plates 20 to be attached to a body 11, the face plate 20 comprising the vertical zone 26 and recesses 30, 32 may be integrally cast with at least the crown 16, toe 13 and heel 12 portions of the club head 10.

Figure 4:
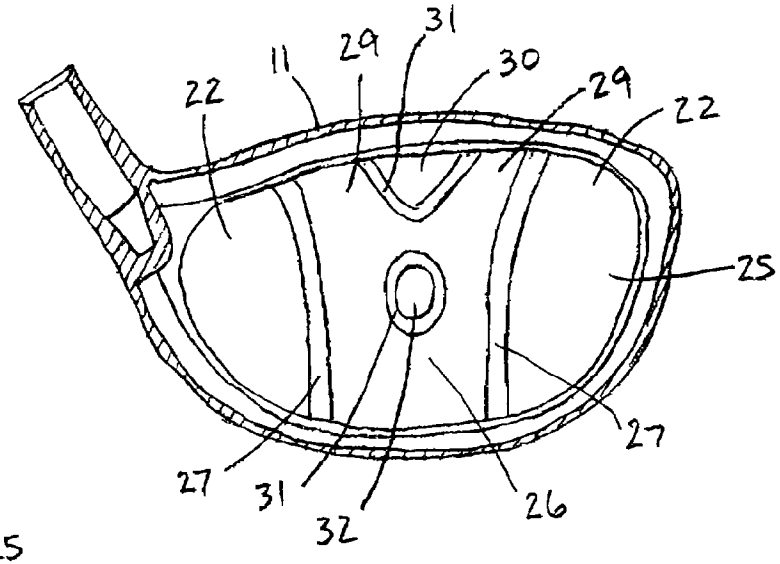
FIG. 4 is a view similar to FIG. 3 showing an alternative embodiment of the vertical zone with central and upper recesses.
Figure 10:
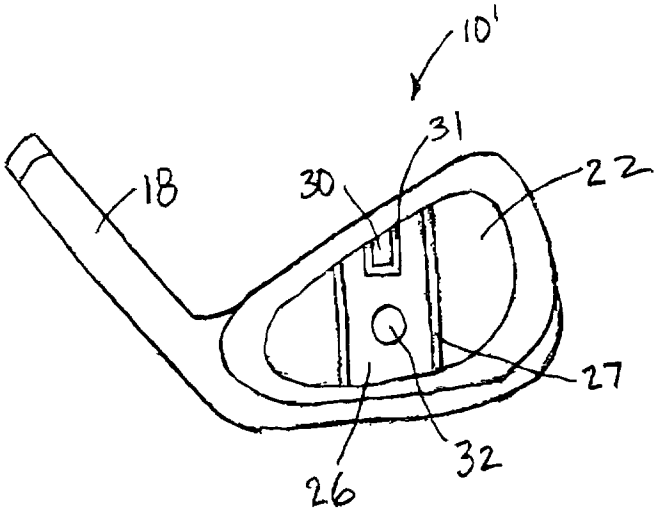
FIG. 10 is a view of a rear surface of a face of an iron in another embodiment of the present invention.
Figure 7:
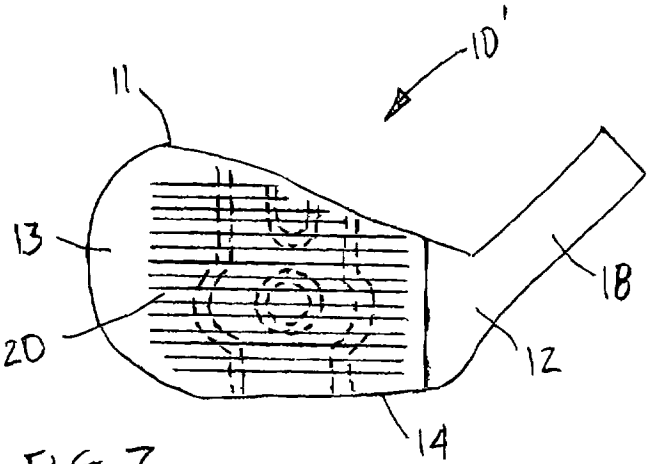
FIG. 7 is a front view of an iron-type club head in another preferred embodiment of the present invention.
Figure 8:
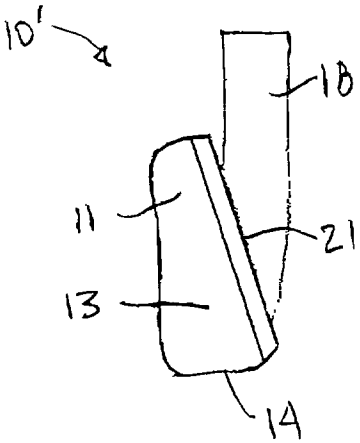
FIG. 8 is a toe end view of the club head of FIG. 7.

Various shapes for the vertical zone 26 and recesses 30, 32 are shown in FIGS. 3–6 and 9–10. The vertical zone 26 may include parallel transition regions 27 (FIG. 6) or it may include a maximum width that occurs adjacent the central recess 32 (FIGS. 3, 5) or at the upper segments 29 (FIG. 4). The central recess 32 may comprise a circular shape or an oval elongated in a crown to sole or heel to toe direction. The upper recess 30 may be substantially U or V-shaped, or it may generally form a rectangle (FIG. 10).

Figure 5A:
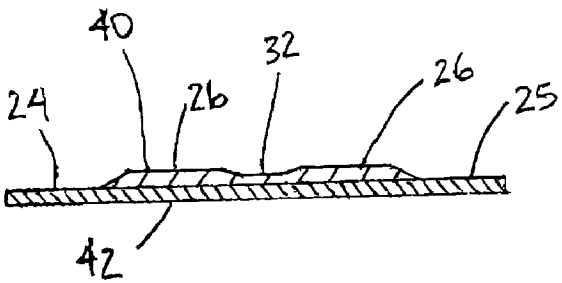
FIG. 5A is a cross-sectional view taken along line D—D of FIG. 5.
Figure 5:
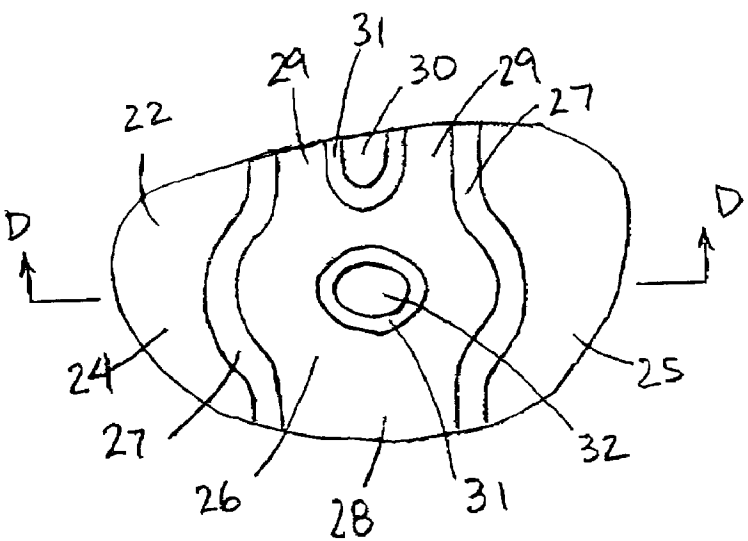
FIG. 5 is a rear view of a face insert in another embodiment of the vertical zone with central and upper recesses.
Figure 9:
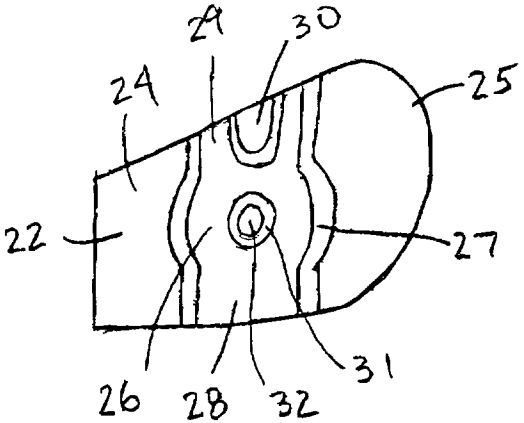
FIG. 9 is a rear view of a face insert for an iron.

The face plate 20 may be forged, stamped or cast of a metal material, and various welding techniques may be employed. As shown in FIG. 5A, it may be desirable to attach a separate portion 40 behind the striking surface portion 42 of the face plate to form the vertical zone 26. Non-metal as well as metal materials maybe employed as known to those skilled in the art. Adhesive methods may be used to attach non-metal materials.

In addition, while the preferred constructions are described in detail for metal woods, i.e., drivers and fairway woods, it will be appreciated that the present invention may be utilized in irons as well. The iron club heads may comprise hollow bodies or perimeter-weighted cavity-back style bodies.

The embodiments described in detail herein are merely illustrative and the present invention may be readily embodied using alternative materials, such as composites, in lieu of metals or their alloys, as well as in hybrid constructions utilizing, for example, laminations of metal and composite materials. The wood-type club heads may be hollow or filled, have volumes greater than 150 cc, and may comprise unitary or multi-piece bodies. Advantageously, the present invention may be employed to achieve COR values greater than about 0.80 across a greater portion of the striking surface than conventional wood-type club heads; e.g., increasing a sweet spot for a relatively "hot" metal wood.

In one preferred method of manufacturing the golf club face of the present invention, a separate metallic face plate 20 is produced using a sheet metal stamping or die cutting technique. Machining as disclosed in applicants' co-pending application, application Ser. No. 10/288,551, filed Nov. 4, 2002, is performed to remove material in the heel and toe zones 24, 25 and central and upper recesses 32, 30. Forging or laser deposition is also contemplated, wherein the vertical zone 26 and recesses 32, 30 are formed after a preliminary outer shape of the face plate 20 is formed. In any of the aforementioned methods, it may be desirable to machine the rear surface 22 of the face plate 20 as a final step in order to more accurately achieve the appropriate thicknesses.

Another step of forming the face for a wood-type club head 10 is to provide a bulge and a roll. This step may be performed before the step of forming the rear surface 22 of the face plate 20. Alternatively, this step may be performed after forming the rear surface 22. The formation of the bulge and roll are not conventionally required for iron heads, such as the embodiments shown in FIGS. 7–10.

For the embodiment (see FIG. 5A) having at least two layers or portions forming the face plate 20, a preferred method comprises forming a striking surface portion 42 having a substantially constant thickness and a separate portion 40 having varying thickness, the separate portion 40 forming the rear surface 22 of the face 20. The method further comprises separately forming the striking surface portion 42 and the separate portion 40 of the face plate 20 and securely attaching them together to form face plate 20. Utilizing two or more layers for the face plate 20 allows the use of a first material for the striking surface portion 42 and a second material for the separate portion 40, wherein at least a portion of the first material is different from the second material. In one example, the striking surface portion 42 may be metal integrally cast with at least the top of the body 11 and the separate portion 40 attached thereto. The separate portion 40 may be at least partially non-metal.

Although the invention has been disclosed in detail with reference only to the preferred embodiments, those skilled in the art will appreciate that additional golf club faces for various golf club heads can be made without departing from the scope of the invention. Accordingly, the invention is defined only by the claims set forth below.

We claim:

1. A golf club head comprising:

a body having a top, a bottom, a toe portion, a heel portion, and a front;

a face plate located at the front of the body, the face plate having an impact surface and an opposed rear surface, the rear surface having a toe zone disposed adjacent the toe, a heel zone disposed adjacent the heel, and a vertical zone disposed between the toe zone and the heel zone and extending from a top edge of the face plate to a bottom edge of the face plate, the vertical zone having a width at least 30% of the total distance measured in a toe to heel direction of the front of the body;

wherein the thickness of the face plate within the toe zone and the heel zone is less than 2.5 mm and the thickness of the face plate within the vertical zone is at least 3.0 mm;

a central recess formed in about the center of the face plate and surrounded by the vertical zone;

an upper recess formed in the face plate, the upper recess intersecting a top edge of the face plate and surrounded by the vertical zone;

wherein the vertical zone has a maximum width measured in a toe to heel direction across the central recess.

2. The golf club head of claim 1, wherein the thickness of the face plate within the central recess is about 0.5 mm less than the thickness of the face plate within the vertical zone.

3. The golf club head of claim 1, wherein the central recess extends a distance between 20% and 50% of the width of the vertical zone, measured in a toe to heel direction of the rear surface.

4. The golf club head of claim 1, wherein the thickness of the face plate within the upper recess is greater than the thickness of the face plate within the heel and toe zones.

5. The golf club head of claim 1, wherein the thickness of the face plate within the heel zone is less than a thickness of the body adjacent the face plate.

6. The golf club head of claim 1, wherein the thickness of the face plate within the toe zone is less than a thickness of the body adjacent the face plate.

7. The golf club head of claim 1, further comprising a first transition region extending between the vertical zone and the toe zone having a first transition width, a second transition region extending between the vertical zone and the heel zone having a second transition width, and a third transition region extending between the central recess and the vertical zone having a third transition width, wherein the sum of a central recess width and the third transition width is approximately equal to 20% to 50% of the sum of a maximum vertical zone width, the first transition width, and the second transition width.

8. A golf club head comprising:

a body having a top, a bottom, a toe portion, a heel portion, and a front;

a face plate located at the front of the body, the face plate having an impact surface, an opposed rear surface, the rear surface having a toe zone disposed adjacent the toe, a heel zone disposed adjacent the heel, and a vertical zone disposed between the toe zone and the heel zones and extending from a top edge of the face plate to a bottom edge of the face plate, the vertical zone having a width at least 30% of the total distance measured in a toe to heel direction of the front of the body, wherein the thickness of the face plate within the toe and heel zones is less than 2.5 mm and the thickness of the face plate within the vertical zone is at least 3.0 mm;

a central recess formed in about the center of the face plate and surrounded by the vertical zone; and an upper recess formed in the face plate, the upper recess intersecting a top edge of the face plate and surrounded by the vertical zone.

* * * * *